United States Patent [19]

Domenéch

[11] 3,950,791

[45] Apr. 20, 1976

[54] BELT LOOP FOR GARMENTS

[75] Inventor: Joseph Domenéch, Paris, France

[73] Assignee: Societe Industrielle des Vetements Merignac, Paris, France

[22] Filed: Mar. 31, 1975

[21] Appl. No.: 563,442

[30] Foreign Application Priority Data

Apr. 2, 1974 France ..... 74.11641

[52] U.S. Cl. ..... 2/236; 2/271

[51] Int. Cl.[2] ..... A41F 9/00

[58] Field of Search ..... 2/271, 236, 220, 237

[56] References Cited

UNITED STATES PATENTS

| | | | |
|---|---|---|---|
| 673,741 | 5/1901 | Thomas et al. | 2/271 |
| 1,436,277 | 11/1922 | Manning et al. | 2/271 X |
| 2,752,703 | 7/1956 | Halperin | 2/271 X |
| 3,789,431 | 2/1974 | Rand | 2/236 |
| 3,872,518 | 3/1975 | Zaoui | 2/271 X |

*Primary Examiner*—Alfred R. Guest

*Attorney, Agent, or Firm*—Cushman, Darby & Cushman

[57] ABSTRACT

A belt loop for a garment such as a pair of trousers comprises a band of material sewn onto the garment to form a first belt loop and a larger, second belt loop overlapping the first loop and extending vertically beyond it. In addition to the two loops, a cloth belt may also be incorporated.

4 Claims, 1 Drawing Figure

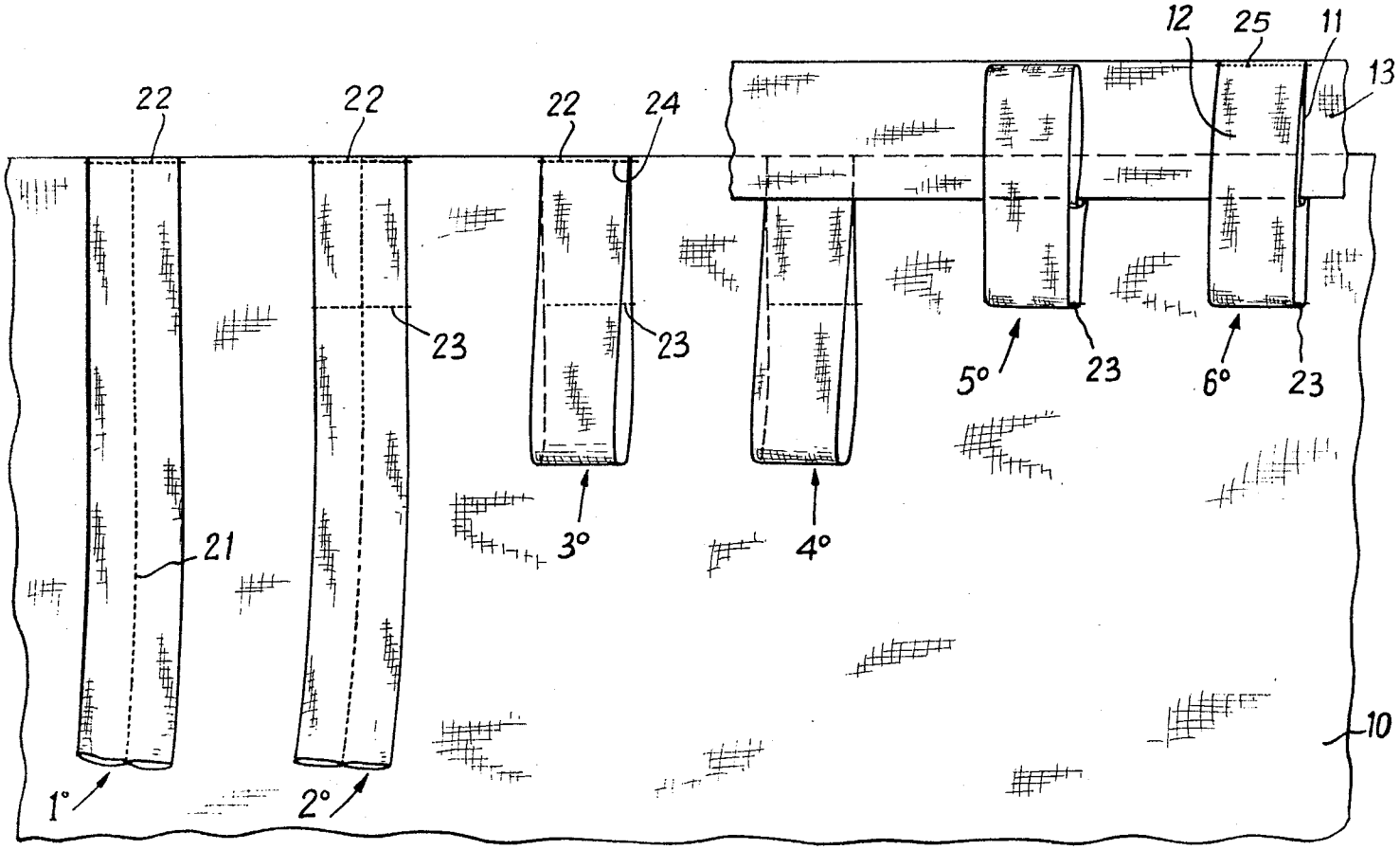
13
11
25
12
23
6°
23
5°
4°
24
23
22
3°
23
22
2°
21
22
1°
10

BELT LOOP FOR GARMENTS

BACKGROUND OF THE INVENTION

The invention relates to a belt loop for garments such as skirts and trousers, comprising a band of fabric attached vertically to the garment by sewing.

If a fabric or leather belt is to hold trousers or a skirt satisfactorily, it is necessary for the belt loops of that garment to be of dimensions suitable for the width of the belt. If wide loops are provided, they ride up in an unsightly manner if the belt is too narrow; if the loops are too narrow, a larger belt simply cannot be worn.

The aim of the invention is to provide trouser loops which make it possible to fit either wide or narrow belts while providing in each case good adaptation of the loops to the size of the belt.

SUMMARY

According to the invention this aim is achieved through the fact that the belt loop comprises a first loop, and a second loop overlapping the first loop and extending vertically beyond it.

When the garment incorporates a sewn belt, likewise known as a fabric belt, the second loop is sewn at its top to the top of the first loop and is sewn at its bottom to the garment substantially below the bottom of the fabric belt.

In one advantageous embodiment the two loops are in a single piece which is folded and sewn at its fold to the top of the garment.

It is advantageous for the single piece constituting the two loops to be disposed in the form of a flattened band having two end folds, for the ends of the band to be sewn together to the garment, and for each of the end folds to be sewn to the garment respectively above and below the stitching of the ends joined together.

In a preferred embodiment, a first end of the band is sewn to the garment substantially at the height where the fabric belt is sewn, before the fabric belt is fitted, a first end fold is formed by stitching, the second end is sewn to the first end at the latest when the fabric belt is fitted, the band is flattened to obtain the two end folds and the second end fold is sewn at the top of the fabric belt.

BRIEF DESCRIPTION OF THE DRAWINGS

Reference will be made to the accompanying single FIGURE, which shows the various successive operations of forming, on trousers or a skirt 10, a belt loop according to the invention which is shown fitted at reference 6.

DESCRIPTION OF THE PREFERRED EMBODIMENT

The loop shown at 6 is a double loop making it possible to use selectively a 30 mm belt in a first loop 11 or a 50 mm belt in a second loop 12. This double loop is fitted with the loop 11 on each side of a fabric belt 13 of the garment and with the loop 12 above the first loop and extending 20 mm downwards beyond it.

A band of fabric 21, for example in the form of a tube, is intended to form the double loop 11-12. A piece of a length of 14 cm is sewn by one end 22 to the edge 14 of the garment 10 at belt height, in such a manner that it extends downwards from the garment on the outside of the latter (first operation). At 30 mm below the belt the band 21 is sewn to the garment by a second horizontal seam 23 (second operation).

The band is then folded upwards and its second or free end joined to the first or upper end by a second seam at the edge of the garment at 24 (third operation).

The fabric belt 13 is then fitted by sewing the garment to the edge of the belt, as is known per se (fourth operation).

The band is then turned upwards to form a flattened loop of which one end fold is formed by the seam 23 while the other end fold is joined to the top edge of the fabric belt 13 (fifth operation), to which it is sewn at 25 (sixth operation).

In an alternative form of production the stitching 23 may be made first and the two ends fastened by the single seam 24 or even by only the stitching of the fabric belt 13.

Other methods of fitting may be employed without departing from the scope of the invention. Thus, it will be possible to sew the top end fold by inserting it between the fabric belt and the lining, as is known per se for trousers or skirt loops. In this case it will be sufficient to provide an adequate length of band 21.

The invention may also be applied to other garments than trousers or skirts, for example to boiler-suits, without departing from its scope. In this case the characteristics of the invention may be explained by substituting the expression "waistband" of the garment for the expression "top of the garment", which is used herein solely for convenience of explanation, since this corresponds to the most general case.

I claim:

1. A belt loop in combination with a garment, such as skirts and trousers, comprising a band of material fitted vertically to the garment by sewing, characterized in that it comprises a first loop of material, and a second loop of material overlapping said first loop and extending vertically beyond it, the single piece constituting the two loops being disposed in the form of a flattened band having two end folds, the ends of the band being sewn together to the garment, and each of the end folds being sewn to the garment, respectively above and below the stitching of the ends joined together.

2. A belt loop for garments according to claim 1, wherein the first loop of material is sewn at its top to the top of a fabric belt of the garment and at its bottom to the bottom of the fabric belt, and said second loop is sewn at its top to the top of said first loop and is sewn at its bottom to the garment substantially below the bottom of the fabric belt.

3. A belt loop according to claim 2, characterised in that the two loops are in one piece folded and sewn at the fold at the top of the garment.

4. A belt loop according to claim 1, characterised in that a first end of the band of material is sewn to the garment substantially at the height of the seam of the fabric belt before the fabric belt is fitted, stitched to form a first end fold at a lower point, the second end is sewn to the first end, at the latest when the fabric belt is fitted, the band is flattened to obtain the two end folds, and the second end fold is sewn to the top of the fabric belt.

* * * * *